United States Patent [19]

Olsen

[11] 4,304,506

[45] Dec. 8, 1981

[54] MARINE STRUCTURE

[75] Inventor: Olav Olsen, Oslo, Norway

[73] Assignees: A/S Høyer-Ellefsen; Ing. T. Furuholmen A/S; Ing. F. Selmer A/S, all of Norway

[21] Appl. No.: 60,184

[22] Filed: Jul. 24, 1979

[30] Foreign Application Priority Data

Aug. 7, 1978 [GB] United Kingdom ..... 32430/78

[51] Int. Cl.[3] ..... E02B 17/00

[52] U.S. Cl. ..... 405/224

[58] Field of Search ..... 405/195, 203, 208, 222, 405/224, 225, 226, 227, 274

[56] References Cited

U.S. PATENT DOCUMENTS

| | | | |
|---|---|---|---|
| 3,553,922 | 1/1971 | Moore et al. | 405/274 X |
| 3,945,212 | 3/1976 | Mo | 405/222 X |
| 3,990,254 | 11/1976 | Mo | 405/203 |
| 3,999,395 | 12/1976 | Broms et al. | 405/224 X |

*Primary Examiner*—David H. Corbin

*Attorney, Agent, or Firm*—Larson and Taylor

[57] ABSTRACT

Marine structure having a base and a foundation means projecting downwardly from the base for pressing into the sea bed. The foundation comprises a wall system with pile means on both sides of the wall(s).

12 Claims, 6 Drawing Figures

MARINE STRUCTURE

BACKGROUND OF THE INVENTION

The present invention relates to a marine structure intended to be supported by the sea bed. The marine structure may for instance be a platform suitable for use in connection with offshore hydrocarbon production. More particularly, but not exclusively, the marine structure is intended to be installed on offshore sites subjected to seismic activities. In particular, the present invention relates to foundation means supporting the marine structure on the sea bed.

A foundation system has previously been disclosed in U.K. Patent Specification No. 1.417.471. This specification describes a marine structure consisting of a base which is intended to be supported by the sea bed and has three or more cells, at least some of which have a bottom. The marine structure consists further of a superstructure projecting upwards away from the sea bed and several hollow downwardly open skirts which project downwardly from the base to a lower level than said cell bottoms. The skirts are formed as an integral unit with the base and have a length which enables them to be pressed down into the sea bed to cooperate directly with the skirts to support the marine structure in position on the sea bed. The skirts are located with at least some parts thereof extending along the periphery of the base, said parts being joined to form a continuous barrier wall along the periphery of the base. At least three of the skirts have a pumping system associated therewith such as to permit righting of the structure into an upright position.

The present invention relates in particular to a support for a marine structure to be submerged onto the submarine bed and anchored or founded in such a way that the structure will be able to withstand large forces in lateral direction without capsizing, tilting or undergoing structural damage.

Since the marine structure particularly is designed to operate in areas subjected to seismic activities, the support will be subjected to two major types of environmental forces. These are:

(a) forces due to wind and wave action, and (b) forces imposed on the foundation due to earthquakes.

A marine structure according to the present invention may for instance be designed to operate at depths exceeding 100 ft. The horizontal forces imposed on the structure due to wave action at such depths may be of the order of 30,000 to 60,000 tonnes while the moments very well may exceed 2,000,000 tonnes-m at the mudline. These forces are to be transferred through the support or foundation to the sea bed. Hence, the foundation means should be of a type which is rigid enough to support the marine structure in position, restraining the tendency of the platform to move in lateral direction or from tilting.

On the other hand, a support or foundation means which is flexible enough to reduce the forces imposed by seismic activities on the foundation means (and the structure), is required.

BRIEF SUMMARY OF THE INVENTION

According to the present invention the foundation means is formed as an integral unit with the base of the marine structure. It has a length which enables it to be pressed down into the sea bed soil to permit denser layers of sea bed soil to cooperate directly with the foundation means to support the marine structure in position on the sea bed. The foundation means comprises a wall system or a skirt system with pile means arranged on both sides of the wall(s) or skirt(s). The pile means are intended to transfer forces from the structure to the sea bed soil or vice versa.

DETAILED DESCRIPTION

In order to obtain as large foundation area as possible, the foundation means extends preferable at least along the periphery of the lower end of the base whereby the entire base area acts as foundation area. Such an arrangement makes it possible to distribute forces and moments imposed by waves and wind over a large area.

The foundation means is designed to accept large deformations for severe ground motions. As previously described it comprises two separate parts, namely a wall system and pile means associated therewith. The horizontal and vertical loads are mainly carried by said pile means while the wall system is mainly designed to divide the base underneath the marine structure into compartments, thus forming a barrier along said periphery and at least forming one compartment defined by the base, the sea bed and the wall(s).

The foundation means is of a type which, when the soil is subjected to seismic activities, allow the soil to move to and fro in lateral direction more or less independent of the base and without resulting in corresponding oscillations in the base and the deck superstructure. The foundation means is designed to be flexible so as to allow "large" deformations and yet may withstand large forces when subjected to seismic loads. The lateral deflection of the foundation means may for example exceed 20–40 cm, while the lateral seismic forces may exceed 200.000 tonnes.

A foundation system in accordance with the present invention, which is pressed down into the sea bed soil, has several additional inherent advantages. By using such a system, the sliding surface, which is critical for the design of any marine structure, is moved further down. At this lower level the shear force required to move the structure in lateral direction will normally be greater than at the mud line. In addition there is a passive soil pressure at the front edge and an active soil pressure at the rear edge (when seen in direction of the imposed horizontal force) which together produce a substantial resistive force. Frictional forces are also obtained along the part of the outer walls which lies parallel to the direction of the imposed horizontal force.

Another inherent advantage of the foundation system is the increased friction/adhesion in the vertical direction, tending to oppose vertical movement of the structure.

By dividing the foundation system into different compartments, the marine structure is stabilized in its position on the sea bed both against movement in the horizontal direction and in the vertical direction and against tilting. A movement upwards will produce a "vacuum" and thus suction in those compartments which move upwards, while a movement downwards will produce an increased pressure in the compartments moving downwards and thus resistance against downward movement of those compartments which move downward. The foundation system also increases the moment of the soil retention forces when the marine structure tends to rotate about a horizontal axis.

According to a preferred embodiment, the pile means comprises piles which are arranged in pairs, one pile on each side of the wall(s). The pile means may preferably be arranged in contact with the wall(s). Optionally, the piles may be arranged in spaced relation to the wall(s).

The piles may for instance be made of steel blanks, prestressed concrete beams, or of tubes, and may have increasing dimensions in upwards directions. The shape and dimensions of said piles are amongst others dependent upon the required length of the foundation system, required stiffness and deformations, these parameters being dependent upon the soil properties, the design wave forces and the design earthquake forces expected to occur at that specific site.

Both the wall system and the pile means are designed to accommodate certain deformations.

According to the present invention the wall thickness may be reduced to a minimum, since the possibilities of buckling is reduced due to the pile means arranged on both sides of the wall(s).

A marine platform as described herein may be built in a conventional manner, i.e. the bottom section of the base and the foundation means are built in a dry dock, etc. During the construction phase in dry dock, the bottom section is mainly supported by the pile means.

As previously described, the pile means may be arranged in a spaced relation to the wall(s). The maximum lateral distance between the piles and the wall(s) is governed by the lateral seismic force expected to be imposed on the foundation means and the designed deflection of the piles and the wall(s). In general, however, the pile means are arranged in contact with the wall(s).

The number of piles, their dimensions and position, and the stiffness of both the wall system and the piles are governed by the maximum expected seismic load, expected to appear at that particular site.

It should be noted that the length of each pile may be varied. If required, the piles may project below the lower edge of the wall(s).

The invention will now be described by way of example with reference to the accompanying drawings in which.

Figure 1:
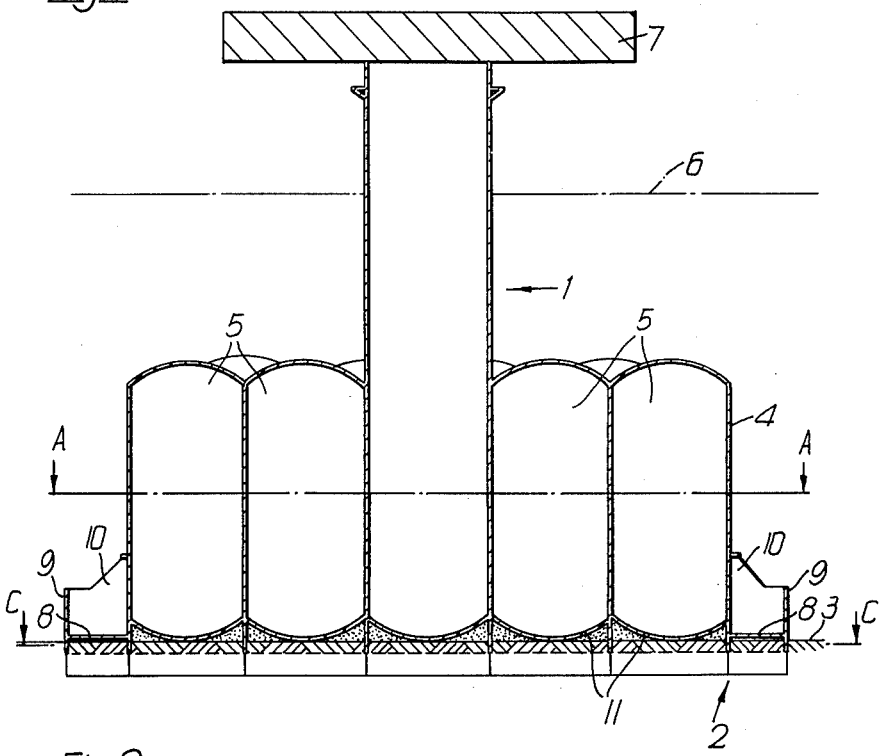
FIG. 1 shows a sectional elevation of one embodiment of a marine structure having foundation means projecting downwardly from a base.
Figure 2:
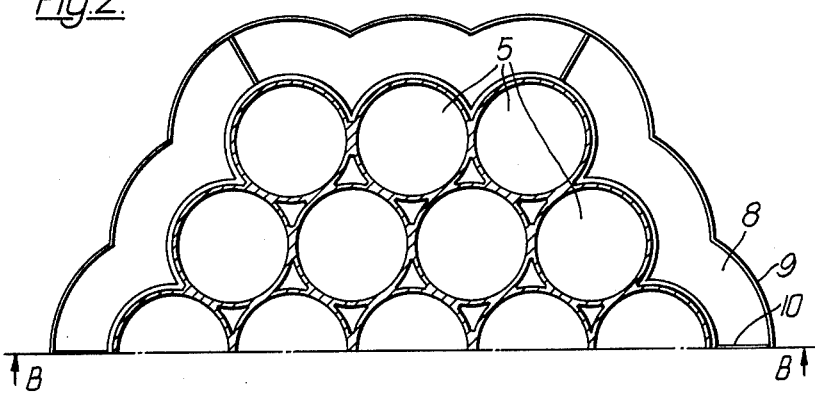
FIG. 2 shows a horizontal half-section of the embodiment of FIG. 1, along line A—A on FIG. 1.

FIG. 1 shows a section elevation of one embodiment of a marine structure 1 having foundation means 2 which is pressed down into the sea bed 3. The marine structure 1 comprises a base 4 formed by several contiguous and vertical cells 5. One of the cells extends up above the sea level 6, supporting a deck superstructure 7 above the sea level. In order to increase the foundation area of the marine structure 1 without significantly increasing the wave forces acting on the structure, the base 4 has at its lower end a cantilevered slab 8 and a ring wall 9 extending along the periphery of said slab 8. The ring wall 9 may, if required, be stiffended by struts or partition walls 10. At its lower end, each cell 5 in the embodiment shown on FIG. 1 is terminated by a bottom dome 11. It should be appreciated, however, that the base may be terminated by a substantial horizontal slab, this slab lying at the same level as the peripheral slab 8.

Figure 3:
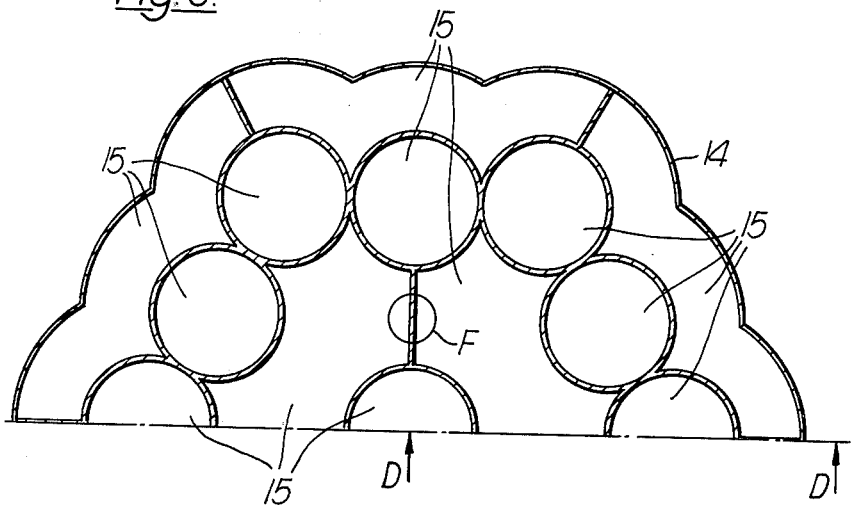
FIG. 3 shows a horizontal half-section of the foundation means of FIG. 1, along line C—C on FIG. 1.
Figure 4:
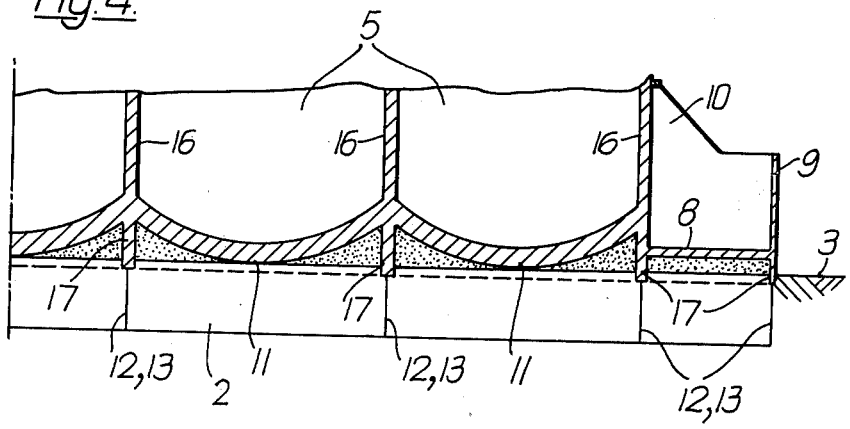
FIG. 4 shows a vertical section of a lower part of the base and of the foundation means along line D—D on FIG. 3.

At its lower end the base 4 has foundation means 2. The foundation means comprises a combination of pile means 12 and one or more wall(s) or skirt(s) 13. The configuration of said foundation means 2 is shown in FIG. 3. The combination of a wall 13 and piles 12 are arranged along the periphery of the slab 8, forming a continuous, pressure tight barrier 14. In addition, the area within said barrier 14 is divided into separate compartments 15 by means of said combination of walls 13 and piles 12. According to the embodiment shown in FIGS. 1–4, the foundation means 2 (the walls 13 and piles 12) are made as a direct continuation of the ring wall 9, the cell wall 16 of the central cell and the cell walls of the outer ring of cells 5. It should be appreciated that the present invention is not limited to the configurations shown and described in conjunction with the drawings, but may have any suitable shape. Further, the foundation means does not necessarily need to form a continuation of said cell walls 16 and ring wall 9.

The foundation means is rigidly fixed to the marine structure 1, forming a static unit with the base 4. From a practical point of view the upper portion of the foundation means is made of concrete forming a monolithic unit with the base. This part is denoted as concrete skirts 17 on FIG. 4.

Figure 5:
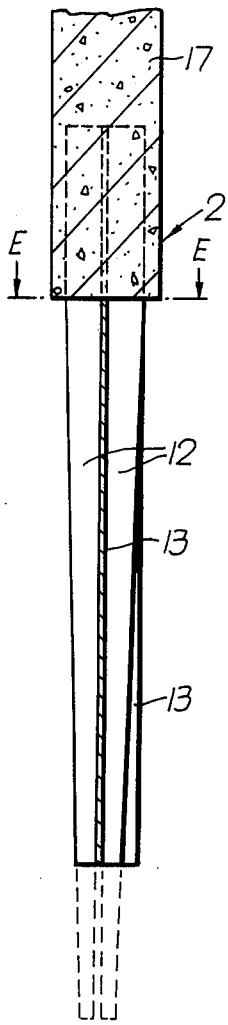
FIG. 5 shows an enlarged vertical section through part of the foundation means.
Figure 6:
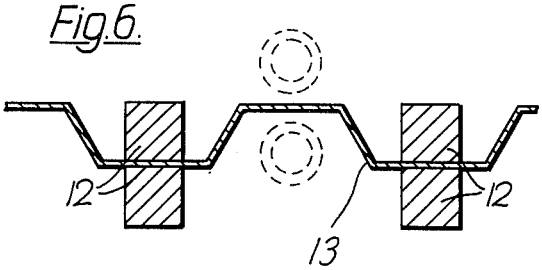
FIG. 6 shows a horizontal section of parts of the foundation means along line E—E on FIG. 5.

FIG. 5 shows an enlarged vertical section of the foundation means 2 marked. According to the embodiment shown, the foundation means consist of piles 12 and a steel wall or a skirt 13. The upper end of the wall and the piles is rigidly fixed to a concrete wall or skirt 17. The piles shown in FIGS. 5 and 6 are formed of standard steel blanks or steel bars with square cross sectional area. These are arranged in contact with the steel wall or skirt 13. As shown on FIG. 6, the piles are arranged in pairs, directly opposite each other. It should be appreciated, however, that the present invention is not limited to such an arrangement. In fact, the piles may be arranged in pairs as shown on FIG. 6 or laterally spaced, the only limitation being that piles should be arranged on both sides of the wall(s). Further, the skirt is formed as a corrugated wall. The corrugated wall is made up of standard elements which are welded together in desired pattern to form said wall.

It should be appreciated, however, that the wall system may be formed of cylindrical tubes or in any suitable shape without deviating from the scope of the invention. The pile means may be formed of steel tubes, steel blanks with triangular, square, rectangular or any polygonal shape, or the pile means may be made of reinforced concrete bars of any suitable shape.

Both the piles and the walls may be equipped with penetrating cutting edges.

Further, the upper cross sectional area of each pile may be larger than the lower cross sectional area, the piles being tapered.

In order to enable the structure to be pressed down into the sea bed soil, the foundation means have a pumping system associated therewith so as to permit trapped water to escape during the penetration phase. The foundation means may also be equipped with a grouting system so that the position of the marine structure can be secured by final grouting, as shown on FIGS. 1 and 4.

As shown in dashed line in FIG. 5, the piles may project below the lower edge of the walls. As shown in dashed lines in FIG. 6, the piles may be spaced from the walls and they may be round.

What we claim is:

1. A marine structure comprising a base which is intended to be supported by the sea-bed and foundation means projecting downwardly from the base, the foundation means being formed as an integral unit with the base and having a length which enables the foundation means to be pressed down into the sea-bed to permit layers of sea-bed soil to cooperate directly with the foundation means to support the marine structure in position on the sea-bed, the foundation means comprising wall means and pile means, said wall means comprising a plurality of wall elements projecting downwardly from said base, at least one of said wall elements extending along the periphery of said foundation means, and said pile means comprising a plurality of downwardly extending piles, said piles being located adjacent to and on opposite sides of said peripheral wall element and distributed along said peripheral wall element and being constructed and arranged such that the horizontal and vertical loads are mainly carried by said pile means when said marine structure is installed on a sea-bed.

2. A marine structure as claimed in claim 1, wherein the piles are arranged in pairs, the piles of each pair being opposite one another and on opposite sides of the wall elements.

3. A marine structure as claimed in claim 1, wherein at least one of the piles projects below the lower edge of the wall elements.

4. Marine structure as claimed in claim 1, wherein the piles are arranged in spaced relation to the wall elements.

5. Marine structure as claimed in claim 1, wherein the piles are formed of steel blanks.

6. Marine structure as claimed in claim 1, wherein the piles are formed of prestressed concrete beams.

7. Marine structure as claimed in claim 1, wherein the piles have varying dimensions in vertical direction.

8. Marine structure as claimed in claim 7, wherein the pile means have a larger upper cross sectional area.

9. Marine structure as claimed in claim 7, wherein the piles are tapered.

10. A marine structure as claimed in claim 1, wherein the piles are arranged in contact with the wall elements.

11. A marine structure as claimed in claim 1, wherein the piles are rigidly fixed to the lower end of the base.

12. Marine structure as claimed in claim 1, wherein the piles are formed of tubes.

* * * * *